United States Patent [19]

Kashyap et al.

[11] 4,336,435

[45] Jun. 22, 1982

[54] MICROWAVE APPARATUS FOR HEATING LIQUID IN A CLOSED PLASTIC CONTAINER

[75] Inventors: Satish Kashyap, Kanata; John G. Dunn, Hammond; Lorne Woods, Ottawa; Frank Vachon, Hull, all of Canada

[73] Assignee: Canadian Patents & Dev. Limited, Ottawa, Canada

[21] Appl. No.: 246,892

[22] Filed: Mar. 23, 1981

[51] Int. Cl.[3] ..... H05B 6/80

[52] U.S. Cl. ..... 219/10.55 F; 128/214 D; 219/10.55 R; 219/10.55 M; 219/10.55 E

[58] Field of Search ..... 219/10.55 R, 10.55 M, 219/10.55 F, 10.55 B, 10.55 E, 10.65, 10.41; 128/214 A, 214 D

[56] References Cited

U.S. PATENT DOCUMENTS

| | | | |
|---|---|---|---|
| 3,154,663 | 10/1964 | Halvorsen | 128/214 A X |
| 3,276,138 | 10/1966 | Fritz | 219/10.55 F |
| 3,315,681 | 4/1967 | Poppendiek . | |
| 3,518,393 | 6/1970 | Besseling et al. | 219/10.41 |
| 3,963,892 | 6/1976 | Camph et al. | 219/10.55 M |
| 4,167,663 | 9/1979 | Granzow, Jr. et al. | 128/214 A X |

FOREIGN PATENT DOCUMENTS

| | | | |
|---|---|---|---|
| 2320440 | 11/1974 | Fed. Rep. of Germany | 219/10.55 R |
| 2366045 | 7/1977 | Fed. Rep. of Germany | 219/10.55 R |

OTHER PUBLICATIONS

Kashyap, S.C., *Dielectric Properties of Blood Plasma,* Electronic Letters, vol. 17, No. 19, Sep. 1981, pp. 713–714.

Sherman, L. A. et al., *A New Rapid Method for Thawing Fresh Frozen Plasma,* Transfusion, vol. 14, No. 6, 12–74, pp. 595–597.

Tomecko, G. W., et al., *Stability of Cefazolin Sodium Admixtures in Plastic Bags after Thawing by Microwave Radiation,* Am. Jour. Hosp. Pharm. vol. 37, Feb. 1980, pp. 211–215.

Ausman, R. K., et al., *The Application of Freeze Microwave Thaw Technique to Central Admixture Services,* Drug Intelligence and Clinical Pharmacy, vol. 14, Apr. 1980, pp. 285–286.

*Primary Examiner*—Arthur T. Grimley
*Attorney, Agent, or Firm*—Edward Rymek

[57] ABSTRACT

The microwave heating apparatus consists of a microwave cavity, a energizing source, a mechanism for holding and agitating a load, and a temperature detector for continuously monitoring the temperature of the load. It is particularly useful for heating and quickly thawing frozen blood plasma or intravenous admixtures as needed. These must be thawed uniformly and to some preselected temperature so as not to destroy their effectiveness. It also helps to prevent wastage of the blood plasma thawed in anticipation of an emergency.

13 Claims, 7 Drawing Figures

MICROWAVE APPARATUS FOR HEATING LIQUID IN A CLOSED PLASTIC CONTAINER

BACKGROUND OF THE INVENTION

This invention is directed to microwave apparatus for heating liquid in closed plastic bags and in particular to apparatus for thawing a liquid which has been frozen in a plastic bag.

Most hospitals freeze and store blood plasma as well as intravenous admixtures for thawing and use at a later date. The blood plasma is quick-frozen at −80° C. in plastic bags which hold 145–285 c.c. of the plasma on the average. The storage is done at −30° C. and when required the bag is thawed by immersing in a hot water bath kept at 37° C.

This method of thawing has various disadvantages. It takes approximately 35 minutes to bring the blood plasma or other admixtures to a reasonable transfusion temperature. This is too long for many emergency situations. Because of the length of time taken, the hospitals sometimes thaw the blood plasma in advance some of which is then wasted. Hot water baths are not always sterile and since some of the plastic bags are permeable, there is also a danger of the material getting contaminated.

As early as 1974, it has been proposed that microwaves be used to thaw fresh frozen blood plasmaas illustrated in the publication by Sherman, L. A. et al.—"A new rapid method for thawing fresh frozen plasma"—Transfusion, Vol. 14, No. 6, 1974, pp. 594–597. This idea has spread to the thawing of frozen intraveneous admixtures as described in the publication by Tomecko, G. W. et al., "Stability of Cefazolin sodium admixtures in plastic bags after thawing by microwave radiation", American J. of Hospital Pharmacy, Vol. 37, 1980, pp. 211–215; and Ausman, R. K. et al. "The application of a freeze-microwave thaw technique to central admixtures services", Drug Intelligence and Clinical Pharmacy, Vol. 14, 1980, pp. 284–287.

In the above method, the plastic bag of frozen material is placed at an appropriate location in the microwave oven and heated for a fixed time. Since the microwave power of the oven, the size and shape of the bag, and the storage temperature may vary, heating for a fixed time in a microwave oven results in an unacceptably high spread in the final temperatures of the bags. Even more serious is the problem of non-uniformity of heating of the bag. The edges, the corners and the ports tend to overheat. In most cases, the blood plasma or admixtures boils in some parts before it reaches a desireable temperature in other parts. This is highly unacceptable since the effectiveness of the plasma or admixture can be completely destroyed at these locations.

SUMMARY OF THE INVENTION

It is therefore an object of this invention to provide microwave apparatus for evenly heating the liquid contents of a plastic bag to a predetermined desired temperature.

It is a further object of the invention to provide microwave apparatus for uniformly thawing the frozen contents of a plastic bag.

These and other objects are achieved in microwave apparatus comprising a microwave oven having a cavity for receiving the plastic bag and a power source for energizing the cavity to heat the contents of the bag. A mechanism which is mounted within the cavity, imparts a motion to the plastic bag thereby agitating the contents within it. A temperature detector senses the temperature of the contents of the bag and deenergizes the cavity when the contents reach a preselected temperature.

In accordance with an aspect of the invention temperature sensor in the detector senses the temperature of the contents of the bag from outside the bag.

In accordance with another aspect of the invention the motion imparting mechanism includes a holder for retaining the plastic bag in a substantially vertical position. The holder includes metal surfaces which shield certain parts of the bag and prevent their overheating. The holder is rotated and/or rocked in the vertical plane. The motion imparting mechanism may include a shaft mounted through the cavity wall so as to be free to rotate with the holder fixed to the shaft within the cavity. A motor is connected to the exterior end of the shaft to generate the rotating and/or a rocking motion of the shaft.

The temperature detector may include an electronic temperature sensor mounted at the end of the shaft within the cavity to contact the plastic bag held by the holder, and temperature control circuit connected to the temperature sensor for deenergizing the cavity at the preselected temperature. The leads used to connect the temperature sensor to the temperature control circuit which is mounted exterior to the cavity, may pass through the interior of the shaft.

Many other objects and aspects of the invention will be clear from the detailed description of the drawings.

DETAILED DESCRIPTION

Figure 1:
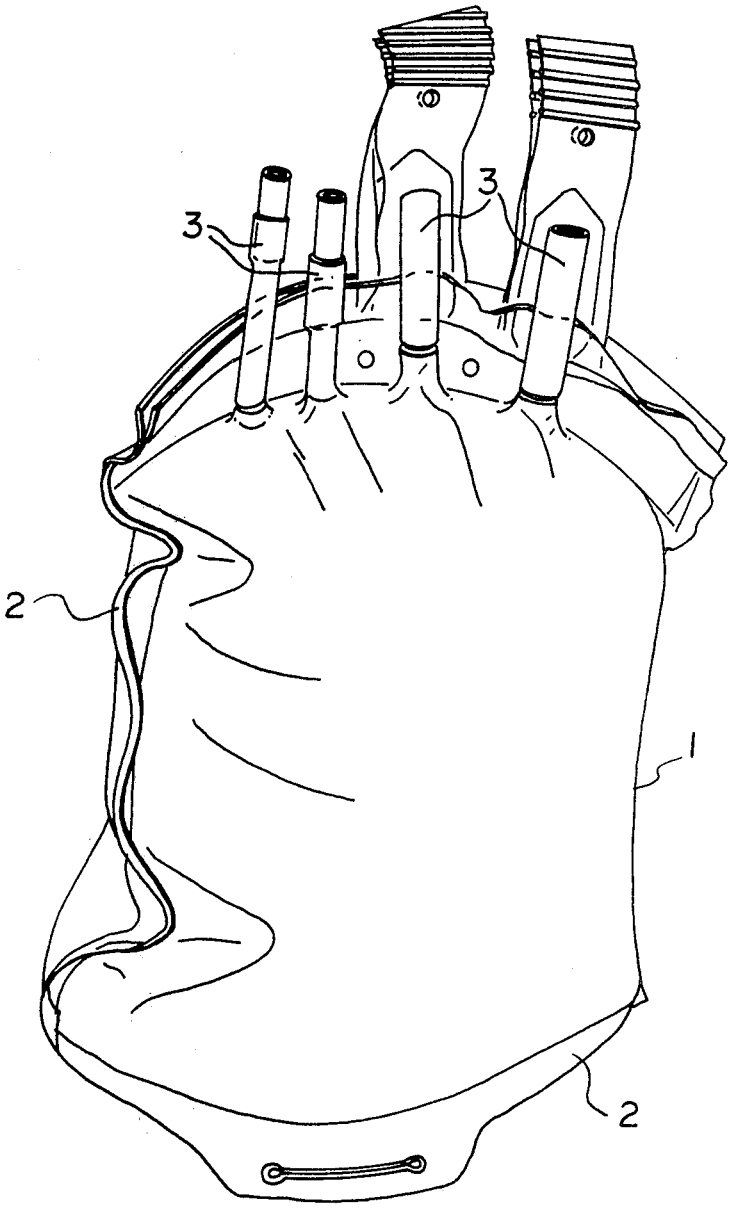
FIG. 1 PRIOR ART
FIG. 1 illustrates a conventional blood plasma bag.

FIG. 1 illustrates a typical blood plasma or intravenous admixture bag 1 which is plastic or pliable. It is normally made of a vinyl, such as polyvinyl chloride, which does not become brittle at the temperatures of down to −80° C. at which blood plasmas are normally quick-frozen. Plasma and admixtures are usually then stored at −30° C. The bag 1 is made from two sheets sealed at their edges 2. Various ports 3 pass through the sealed edge 2 at one end so that the bag can be filled and drained in the conventional manner. These blood plasma bags generally have a volume of from 145 cc to 285 cc. The bags for intravenous admixtures have a volume of 50 or 100 c.c.

Figure 2:
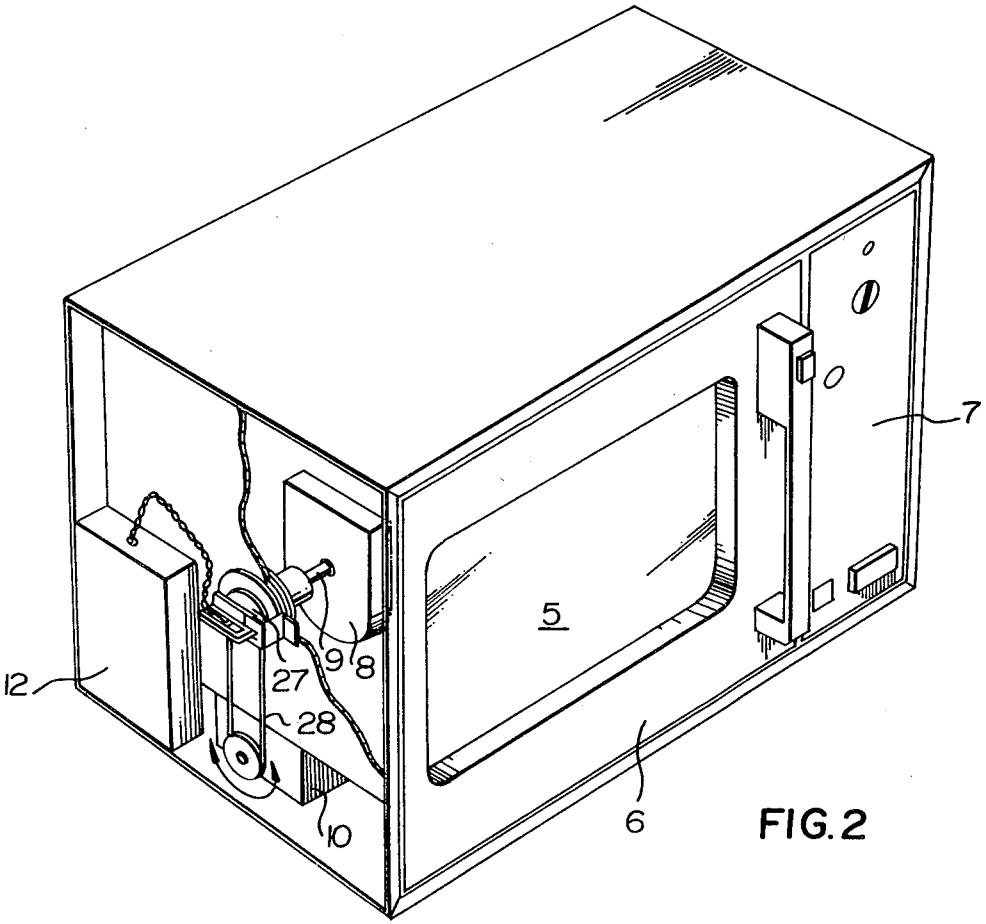
FIG. 2 illustrates microwave apparatus in accordance with the present invention.

Microwave apparatus 4 for heating a bag 1 in accordance with the present invention is illustrated in FIG. 2. The apparatus 4 resembles a conventional oven having a cavity 5 which is accessed by a door 6. The cavity is energized by a microwave source mounted within the structure on the right hand side behind the control panel 7. The cavity 5 is shown with one side cut-away to expose a bag holder 8 within the cavity 5. The holder 8 and shaft 9 are mounted within the cavity 5, support the bag 1 and impart a motion to it in a vertical plane thereby agitating its contents. A vertical plane of rotation is chosen so as to allow entrapped air to scavenge liquid from the edges of the bag 1. Also as ice floats this action tends to aid in the mixing of the ice and liquid mixture. The shaft 9 projects through the cavity 5 wall and is connected to a motor 10 which causes the shaft 9 and thus the holder 8 to rotate in an oscillating manner.

In addition a temperature detector 11 (not shown) is mounted in the shaft 9 so as to be in contact with the bag 1 within holder 8. The temperature detector 11 is connected to a temperature control circuit 12 which is connected to the control panel 7 to switch off the microwave apparatus 4 when the material in the bag 1 reaches a predetermined desired temperature.

Figure 3:
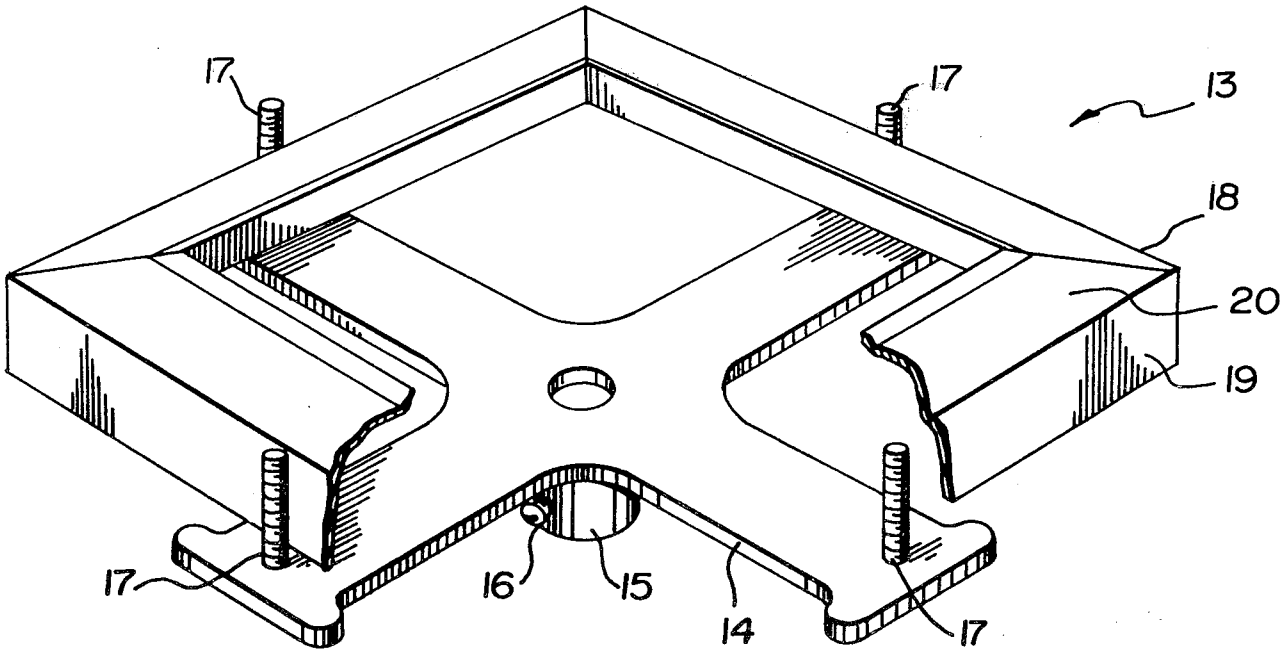
FIGS. 3 and 4 illustrate embodiments of a plastic bag holder.
Figure 4:
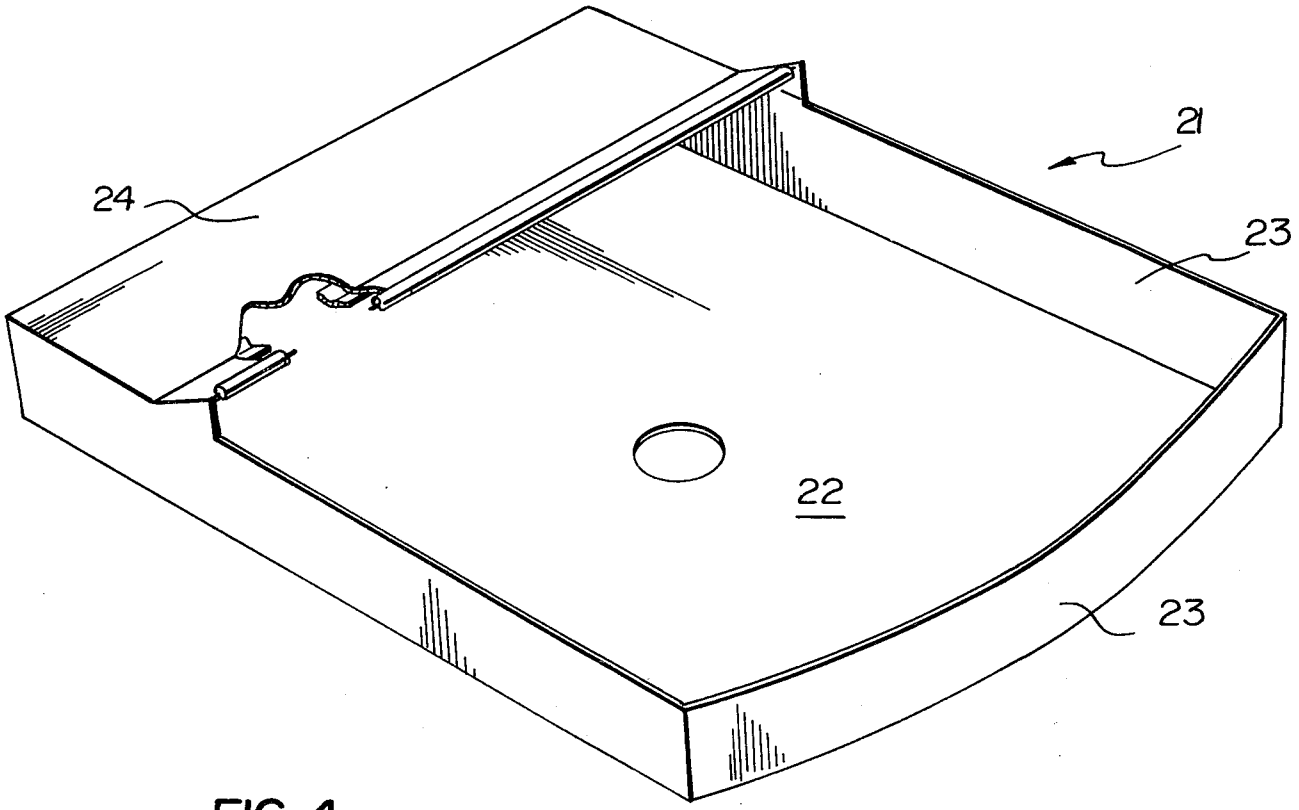

FIGS. 3 and 4 show in detail two embodiments of the bag holder in accordance with the present invention. The bag holder must allow the plastic bag 1 with its frozen contents to be easily introduced into and held within the cavity 5. In addition, the edges 2, corners and tubing 3 of the bag 1 must be shielded to some extent to prevent their overheating. To this end, the holder will include at least some metal, such as stainless steel or copper along its edges.

FIG. 3 illustrates a two-piece holder 13 having a support structure 14 which has a mounting sleeve 15 and a securing screw 16 for mounting the holder 13 onto the shaft 9. A set of pins 17 are fixed to the support structure 14. A removeable frame 18 is secured between the pins 17 by rubber bands or other securing devices. The support structure 14 may be a full or a cut-out surface as shown in FIG. 3. Also it may be made of metal or of a material transparent to microwave energy, such as plexiglass. Frame 18, would normally be made of a metal such as stainless steel or copper, such that the edge 19 and the flange 20 protect the edges of a bag 1 placed in the holder 13.

The holder 21 illustrated in FIG. 4 is an open box type structure having a back wall 22 and side wall 23. A mounting sleeve and securing screw (not shown) are fixed to the underside of the back wall. A flange 24 covers one end of the holder 21 so that the end of the plasma bag 1 with the tubing 3 may be held securely within the holder. The holder 21 would normaly be made of metal such as stainless steel or copper, or of a plexiglass with a metal coating on strategic areas such as walls 23 and flange 24.

A holder 13 or 21 with an all metal back surface would have a slightly lower efficiency, however this type of surface prevents any spurious microwave energy from disrupting the operation of the temperature monitor which is described below.

Figure 5:
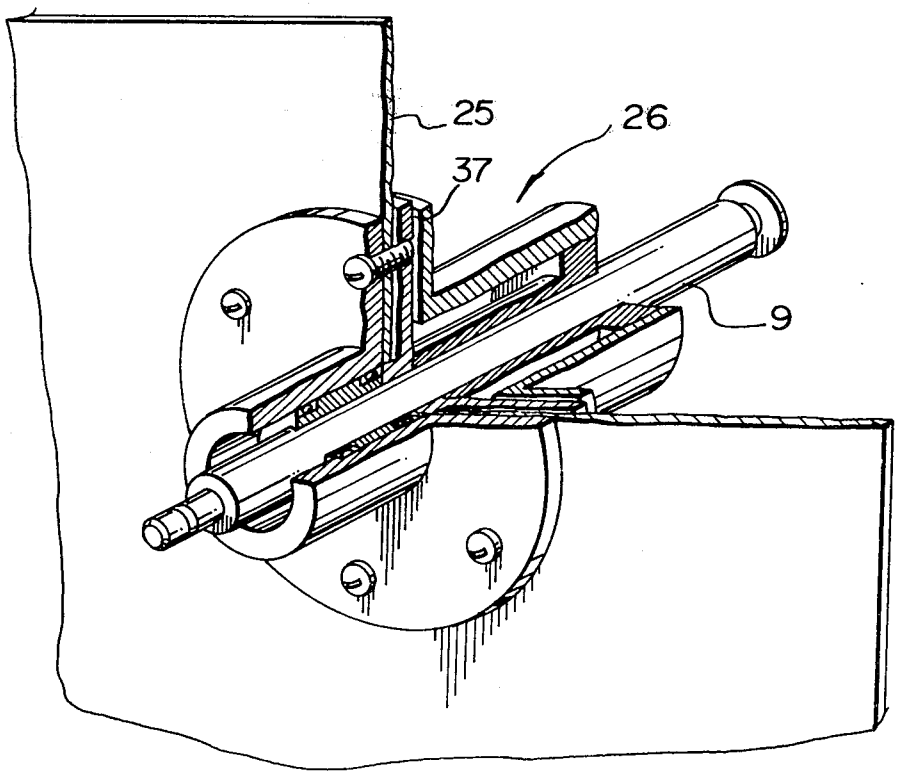
FIG. 5 illustrates the agitation shaft for the bag holder.
Figures 6, 7:
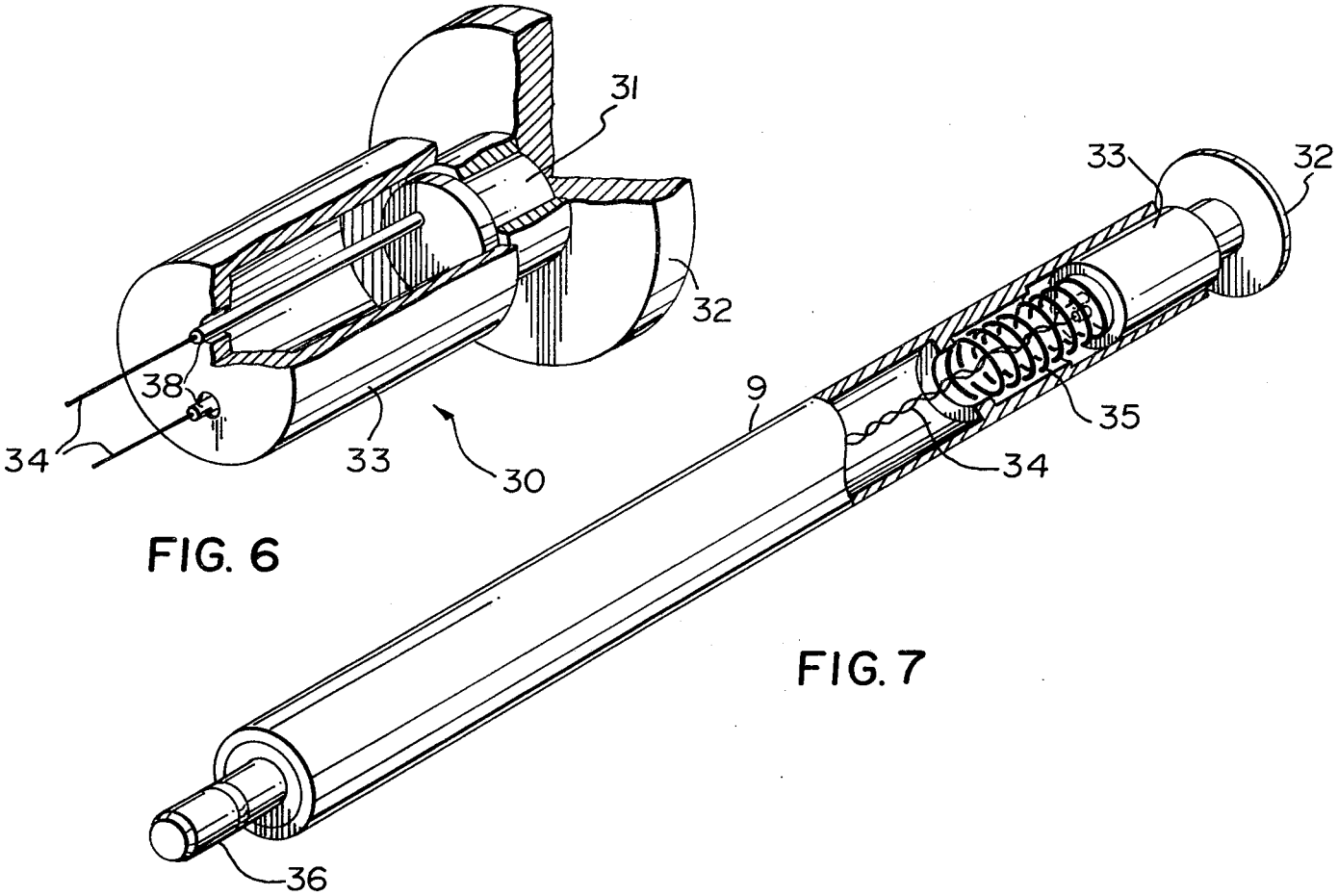
FIG. 6 illustrates a bag temperature sensor.
FIG. 7 illustrates a temperature sensor-shaft arrangement.

As shown in FIG. 2, within the cavity 5, the holder 8 is mounted on a rotatable shaft 9 which protrudes through the cavity 5 wall. The shaft 9 and its mounting may be of the type shown in FIG. 5. The shaft 9 which may be solid or hollow as shown in FIG. 6 for inclusion of the temperature monitor must be sufficiently long to pass through the cavity 5 wall 25, as well as through the wall mounting and choke arrangement 26. The choke 26 is designed to prevent leakage of microwaves from the cavity through the hole for the shaft 9 used for rotating the plasma bag holder 8. Its dimensions are chosen such that, at the frequency of operation (2450 MHz), an electrical short is created at the opening 37 to the cavity 5, thereby preventing any leakage of microwaves to the outside.

A pulley 27 (FIG. 2) is mounted on the outer end of the shaft 9 and connected to the motor 10 by a belt 28. Motor 10 is geared to oscillate back and forth in equal or unequal increments such that the holder 9 is only rocked back and forth or it is rocked as well as rotated. This ensures the uniform heating of the contents in the bag 1 since the thawed portion is swished around forcing a continuous mixing of the contents while it is being heated.

As discussed above, it is desireable to monitor the temperature of the contents of the bag 1 while it is being heated so that heating may be ceased when the desired temperature is reached. FIGS. 6 and 7 illustrate one embodiment of such a temperature monitor. The temperature monitor includes a temperature probe 30 consisting of a temperature sensor 31 to one end of which is fixed a disk 32. The disk 32 contacts the side of a bag 1 in holder 8. The other end of the sensor 31 is fixed to a jacket 33 by means of two stainless steel hypodermic needles 38 which thermally isolate the sensor 31 from the jacket 33 as well as shield the leads 34 from microwave energy, as the leads 34 from sensor 31 pass through jacket 33. The temperature probe 30 is spring mounted within the end of shaft 9 (FIG. 7) with a spring 35 pushing probe 30 outward so that the disk 32 maintains contact with the bag 1 which is being heated. Leads 34 pass through shaft 9 to the outside of the cavity 5 where they may simply be directly connected to the temperature control circuit 12 if the shaft 9 only oscillates, or connected to the control circuit 12 through slip rings 36 fixed to the end of shaft 9, if the shaft rotates.

Sensor 31 may be thermistor, thermocouple or any other well known type of contact sensor. The temperature sensor 31 may alternately be a non-contact type of sensor such as an infrared sensor. In the present embodiment, a two terminal integrated circuit is used. When appropriately biased, it delivers a current in $\mu$A which is proportional to the temperature in °K. The control circuit 12 includes logic circuit which may be set to respond to a predetermined detected temperature so as to switch off the power to the microwave source as well as to the motor 10.

The apparatus in accordance with the present invention provides uniform heating of the bag contents, i.e. to within $\pm 1°$ C. of the present temperature, independent of load volume or microwave power of its source.

Table 1 below illustrates the performance of the apparatus using different volumes of blood plasma as well as different power levels.

TABLE 1

| Sample Vol. (c.c.) | Power Level (Watts) | Initial Temp. (°C.) | Final Temp. (°C.) | Time Taken min:sec |
|---|---|---|---|---|
| 280 | 700 | −30° C. | 22.4 | 4.14 |
| 250 | 700 | " | 20.4 | 3.53 |
| 237 | 600 | " | 22.2 | 4.03 |
| 250 | 600 | " | 20.8 | 4.16 |
| 214 | 500 | " | 21.2 | 4.27 |
| 145 | 500 | " | 22.8 | 3.11 |
| 191 | 400 | " | 22.0 | 4.48 |
| 168 | 400 | " | 20.8 | 4.20 |

It has also been determined that it is preferred to freeze the blood plasma or intravenous admixture bags individually in a container which will ensure that one of the sides of the bag is essentially flat to facilitate temperature monitoring and that the bag will fit conveniently within the thawing holder. The use of such a container would allow freezing of the bags in a substantially horizontal position which assures relatively uniform thickness.

Many modifications in the above described embodiments of the invention can be carried out without departing from the scope thereof and therefore the scope of the present invention is intended to be limited only by the appended claims.

We claim:

1. Microwave apparatus for thawing liquid frozen in a plastic bag comprising:

microwave means having a microwave cavity for receiving the plastic bag and a microwave power source for energizing the microwave cavity to thaw the frozen liquid in the bag;

holder means within the microwave cavity for retaining the plastic bag in a substantially vertical position and for shielding strategic areas of the plastic bag from microwave energy;

means fixed to the holder means within the microwave cavity for imparting a motion to plastic bag thereby agitating the thawing liquid in the plastic bag; and temperature means for detecting the temperature of the thawing liquid in the bag and for deenergizing the cavity at a preselected temperature.

2. Microwave apparatus as claimed in claim 1 wherein the temperature means includes sensor means fixed with respect to the holder means for sensing the temperature of the contents of the bag from outside the bag.

3. Microwave apparatus as claimed in claim 1 wherein the motion imparting means further includes means for rotating the holder means in the vertical plane.

4. Microwave apparatus as in claim 1 wherein the motion imparting means further includes means for rocking the holder means in the vertical plane.

5. Microwave apparatus as claimed in claim 1 wherein the motion imparting means includes: a shaft mounted through the microwave cavity wall and fixed to the holder means within the microwave cavity; and motor means connected to the shaft exterior to the cavity for generating the rotating and/or rocking motion of the shaft.

6. Microwave apparatus as claimed in claim 5 wherein the temperature means includes:

an electronic temperature probe mounted at the end of the shaft within the microwave cavity and fixed relative to the holder means to contact the plastic bag;

temperature control circuit connected to the temperature probe for deenergizing the microwave cavity at the preselected temperature.

7. Microwave apparatus as claimed in claim 6 which further includes leads passing through the shaft for connecting the temperature probe and the temperature control circuit mounted exterior to the cavity.

8. Microwave apparatus as claimed in claim 5 wherein the electronic temperature probe includes:

a heat conductive disk for contacting the plastic bag;

an electronic temperature sensor fixed to the disk for providing a temperature signal on a pair of leads;

a pair of hollow, rigid metal needles with first ends fixed to the sensor, the needles encasing the leads thereby shielding the leads from microwave energy; and a cylindrical jacket located within the end of the shaft for encasing the metal needles and the temperature sensor with one end of the jacket fixed to the remaining ends of the needles.

9. Microwave apparatus as claimed in claim 8 which includes spring means fixed between the interior of the shaft and the cylindrical jacket for allowing relative axial motion.

10. Microwave apparatus as claimed in claim 1 wherein the holder means is an open box having side walls, wherein at least part of the side walls are metalized to shield the strategic areas of the plastic bag.

11. Microwave apparatus as claimed in claim 1 wherein the plastic bag consists of two sheets of plastic material sealed at their edges to form an oblong plastic bag with ports located in the sealed edge; and the holder means consists of an oblong structure having metalized surfaces to shield the sealed edges and ports of the plastic bag.

12. Microwave apparatus as claimed in claim 11 wherein the oblong structure includes a flat back wall adapted to be fixed to the motion imparting means, metalized side walls for shielding the edges of the plastic bag, and a front wall section for retaining the plastic bag within the oblong structure.

13. Microwave apparatus as claimed in claim 12 wherein all of the surfaces of the oblong structure are metalized.

* * * * *